US007922074B2

(12) United States Patent
Long et al.

(10) Patent No.: US 7,922,074 B2
(45) Date of Patent: Apr. 12, 2011

(54) SYSTEM AND METHOD FOR MATCHING COLORED LIDS TO CARTONS

(75) Inventors: Leslie T. Long, Appleton, WI (US); Norman K. Fox, Appleton, WI (US); Jon R. Christensen, Oshkosh, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 823 days.

(21) Appl. No.: 11/848,370

(22) Filed: Aug. 31, 2007

(65) Prior Publication Data

US 2009/0057390 A1 Mar. 5, 2009

(51) Int. Cl.
*G06F 17/00* (2006.01)

(52) U.S. Cl. ..... 235/375; 235/462.01; 235/474; 235/475; 493/52

(58) Field of Classification Search ..... 235/375, 235/385, 462.01, 462.04, 474, 475; 493/51, 493/52, 162; 53/285, 287
See application file for complete search history.

(56) References Cited

U.S. PATENT DOCUMENTS

| | | | | |
|---|---|---|---|---|
| 2,294,273 | A | 8/1942 | Buxbaum | |
| 3,509,688 | A * | 5/1970 | Hartbauer et al. | 53/536 |
| 4,554,955 | A | 11/1985 | Von Lersner et al. | |
| 4,588,880 | A | 5/1986 | Hesser | |
| 4,642,470 | A | 2/1987 | Planke | |
| 4,949,526 | A | 8/1990 | Brogna et al. | |
| 5,154,315 | A * | 10/1992 | Dominico et al. | 221/11 |
| 5,251,426 | A | 10/1993 | Heisler et al. | |
| 5,268,849 | A | 12/1993 | Howlett et al. | |
| 5,900,610 | A * | 5/1999 | Kelly, Jr. | 235/385 |
| 6,048,421 | A * | 4/2000 | White | 156/69 |
| 6,378,275 | B1 | 4/2002 | Andersson | |
| D470,768 | S | 2/2003 | Melhede | |
| 6,581,836 | B2 | 6/2003 | Main | |

(Continued)

FOREIGN PATENT DOCUMENTS

JP 2002-037223 2/2002

(Continued)

OTHER PUBLICATIONS

Web Page—Thiele Technologies—Rotary Player.
Web Page—Surface Mount Technology (SMT)—Component Placement.
PCT Search Report, Apr. 3, 2009.

*Primary Examiner* — Steven S Paik
*Assistant Examiner* — William M Anderson, Jr.
(74) *Attorney, Agent, or Firm* — Dority & Manning, P.A.

(57) ABSTRACT

A system and method for matching lids to cartons includes a carton feed conveyor having a plurality of cartons carried at individual flight positions defined along the conveyor, with each of the cartons having a mark applied thereto indicating a type of lid to be applied to the respective carton. A reader is operatively disposed relative to the carton feed conveyor to read the marks. A lid feed conveyor has a plurality of individual flight positions defined thereon, with each flight position on the carton feed conveyor having an assigned flight position on the lid feed conveyor. A lid placer station is supplied with different types of lids from respective separate lid magazines and is disposed along the lid feed conveyor. The lid placer station is in communication with the reader and is configured to select and place lids dictated by the marks from the magazines onto the flight positions on the lid feed conveyor that are assigned to the flight positions on the carton feed conveyor containing the carton and associated mark read by the reader.

17 Claims, 4 Drawing Sheets

U.S. PATENT DOCUMENTS

| | | | | |
|---|---|---|---|---|
| 6,993,887 | B2 | 2/2006 | Dharssi et al. | |
| D530,223 | S | 10/2006 | Mau et al. | |
| 7,184,178 | B2 | 2/2007 | Panunto et al. | |
| 2002/0004732 | A1 | 1/2002 | Quigg | |
| 2005/0039416 | A1 | 2/2005 | Hidding | |
| 2006/0050949 | A1 * | 3/2006 | Spaeth | 382/141 |

FOREIGN PATENT DOCUMENTS

| | | |
|---|---|---|
| JP | 2002-350354 | 12/2002 |
| JP | 2002-231291 | 8/2004 |
| JP | 2004-224397 | 8/2004 |

* cited by examiner

SYSTEM AND METHOD FOR MATCHING COLORED LIDS TO CARTONS

BACKGROUND OF THE INVENTION

Decorative facial tissue dispensers have gained wide acceptance by the consuming public. These dispensers include cartons that are typically circular, oval, or some other rounded sidewall shape, and include decorative colors, graphics, or indicia on the visible sidewalls. The cartons may be designed to coordinate or compliment the user's home décor, and are often displayed in highly visible places as a decorative accessory item.

In manufacturing of these decorative dispensers, it is often the situation that a mix of cartons with different graphic designs are processed in-line essentially in a random distribution. For example, a holiday edition of decorative dispensers may include a number of different holiday-themed graphics printed on the carton sidewalls, with these different themes being in no specific order in the processing line. For the lid application step of the process, this does not present a problem so long as the same lid (i.e., same neutral color) is used for all the designs. However, there are times when lids of a specific color are designated for particular carton graphic designs, particularly for premium grade products. This often results in the need to hand select and assemble the lids to the cartons.

U.S. Pat. No. 6,581,836 describes an apparatus and method for automatic lid selection in a produce packing process wherein different lids are assigned to containers of different types of produce. A separate lidding station is provided for each of the different lids. A symbol is affixed to each container and indicates the contents of the respective container. A reader reads the symbol and the container is directed to one of the many lidding stations to receive the correct lid. This type of system requires a multitude of lid application stations and associated conveyor and control systems, and would be extremely complicated and expensive for use in an in-line high-speed carton assembly process.

U.S. Pat. Appln. Pub. 2005/0039416 describes a color-coded shrink-wrapped closure system wherein beverage containers for different beverages are all provided with a common color cap. The beverages are differentiated by application of color-coded shrink-wrap to the caps. The publication describes that the processing facility can change the reel containing the colored shrink-wrap material based on the particular beverage being bottled at the time. This type of system does not have usefulness where the different beverages are randomly commingled in the same processing line as a result of an intentional random loading of products, a jam condition, or removal of damaged products, all of which would prohibit a strict maintaining of a specific product mix order to downstream lid application.

An efficient, compact, and relatively inexpensive automatic system is needed for matching different types or colored lids to different carton bodies in a high-speed production line. The present invention provides such a system and associated methodology.

SUMMARY OF THE INVENTION

Objects and advantages of the invention will be set forth in part in the following description, or may be obvious from the description, or may be learned through practice of the invention.

In general, the present invention is related to a system and associated method for matching lids to cartons. The system and method have particular usefulness in a manufacturing line that assembles tissue carton dispensers, such as disposable facial tissue dispensers. It should be appreciated, however, that although the system and method are described herein with reference to embodiments related to tissue carton dispensers, the invention is not limited to such use and may have benefit in any manufacturing process wherein a random mix of different types of cartons require a particular type of lid for each respective type of carton.

The system includes a carton feed conveyor having a plurality of cartons carried at individual flight positions defined along the conveyor. These flight positions may be defined by a physical barrier, such as a rail or other guide structure that also helps to align the cartons on the conveyor. In an alternative embodiment, the flight positions need not be defined by a physical member, but may be designated or simply recognized by the control system as spaced apart locations along the conveyor. Each of the cartons carried on the carton feed conveyor has a mark applied thereto that indicates a particular type of lid that should be applied to the respective carton. In a particular embodiment, this mark indicates a particular color of lid to be applied to the respective carton. However, the mark may also indicate a type of lid having a particular graphics pattern, shape, or any other distinguishing feature. The marks may comprise a printed symbol or other indicia that is applied to any desired surface on the container. For example, the mark may be applied to a surface that is not outwardly visible upon complete assembly of the carton and lid. The mark may be applied for example to an inner surface of the carton, on a bottom surface of the carton, and so forth.

A reader is operatively disposed relative to the carton feed conveyor to read the individual marks on the cartons as the cartons are conveyed past the reader. This reader may be any suitable optical reader, such as a bar code reader, scanner, and the like.

A lid feed conveyor is provided having a plurality of individual flight positions defined thereon. Each flight position on the carton feed conveyor has an assigned or associated flight position on the lid feed conveyor. The lid feed conveyor and carton feed conveyor are coordinated so that the respective assigned flight positions arrive at a downstream lid application station together.

A lid placer station is supplied with the different types of lids needed for the respective different cartons in individual respective magazines. The lid placer station is disposed along the lid conveyor and is in communication with the reader and is configured to select the appropriate lid from the magazines dictated by the mark read from the reader. The selected lid is then transferred to the flight position on the lid feed conveyor that is assigned or associated to the flight position on the carton feed conveyor containing the carton (mark) read by the reader. Thus, as the assigned flight positions on the respective conveyors reach the downstream lid application station, the correct lid and carton are brought together for assembly at the application station.

In a particular embodiment, the lid placer station comprises a single lid placer, and the magazines are carried by a lid feeder that moves relative to the lid placer to place the correct magazine of lids adjacent to the lid placer. This arrangement may utilize, for example, a turret placer with a lid feeder (and associated magazines) that reciprocates back and forth relative to the turret placer. In this particular embodiment, all of the different lids are placed by the turret placer at the same relative position with respect to the lid feed conveyor. This embodiment may be desired with regards to a compact and space-efficient configuration.

In an alternative embodiment, the lid placer station may comprise a plurality of different lid placers, with each lid placer assigned a respective lid magazine. These plurality of lid spacers may be spaced apart along a section or portion of the lid feed conveyor within the lid placer station. For example, this configuration may be embodied with individual rotary placers, with each different type of lid being assigned to a respective rotary placer at a unique relative position with respect to the lid feed conveyor.

As mentioned, the system and method has particular usefulness for assembly of facial tissue dispensing cartons. In a unique embodiment, the cartons may have different graphic designs applied thereto and arrive to the downstream carton feed conveyor in random order as a result of intentional random loading or a processing condition that results in disruption of a particular order of the cartons. The magazines at the lid placer station contain different colored lids for each of the different graphics designs. The mark applied to each of the cartons indicates the desired colored lid desired for the particular graphics design on the carton. Eventually, the carton and correct lid will reach the downstream lid application station at the same time wherein the lid is applied to the carton body.

The magazines in the lid feeder may be supplied from auxiliary lid storage devices, particularly for high processing speeds wherein manual reloading of the magazines is prohibitive. For example, the auxiliary equipment might include lid feed hoppers and rotary bowls. For slightly slower speed applications, one or more carousel-type lid dispensers could contain multiple lid stacks, with each stack having a different lid color. The carousel could rotate to dispense the appropriate stacks via a chute or other guide configured between the carousel and the lid feeder magazines. It should be readily appreciated that any type of storage and transfer system may be utilized to supply the lid placer with additional lids upon depletion of the initial magazine of lids.

The present invention also encompasses the methodology for matching lids to cartons in a production line wherein cartons are placed at designated flight positions along a carton conveyor, the cartons having different appearances, such as different graphic designs, and a mark applied thereto indicating a particular type of lid to be applied to the respective carton. This mark is read as the cartons are conveyed on the carton conveyor. The lid required by the mark is assigned to an associated flight position on a separate lid conveyor. Based on the read mark, the proper type of lid from a supply of different types of lids is selected and placed on the associated flight position on the lid conveyor. Movement and the traveling path of the carton and lid conveyors are synchronized so that the associated flight positions arrive at a lid application station at a coordinated time so that the correct lid is applied to the carton.

Various other aspects of the methodology are expressly discussed herein with respect to the described system, or are readily apparent from the present discussion.

Other features and aspects of the present disclosure are discussed in greater detail below.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

Figure 1:
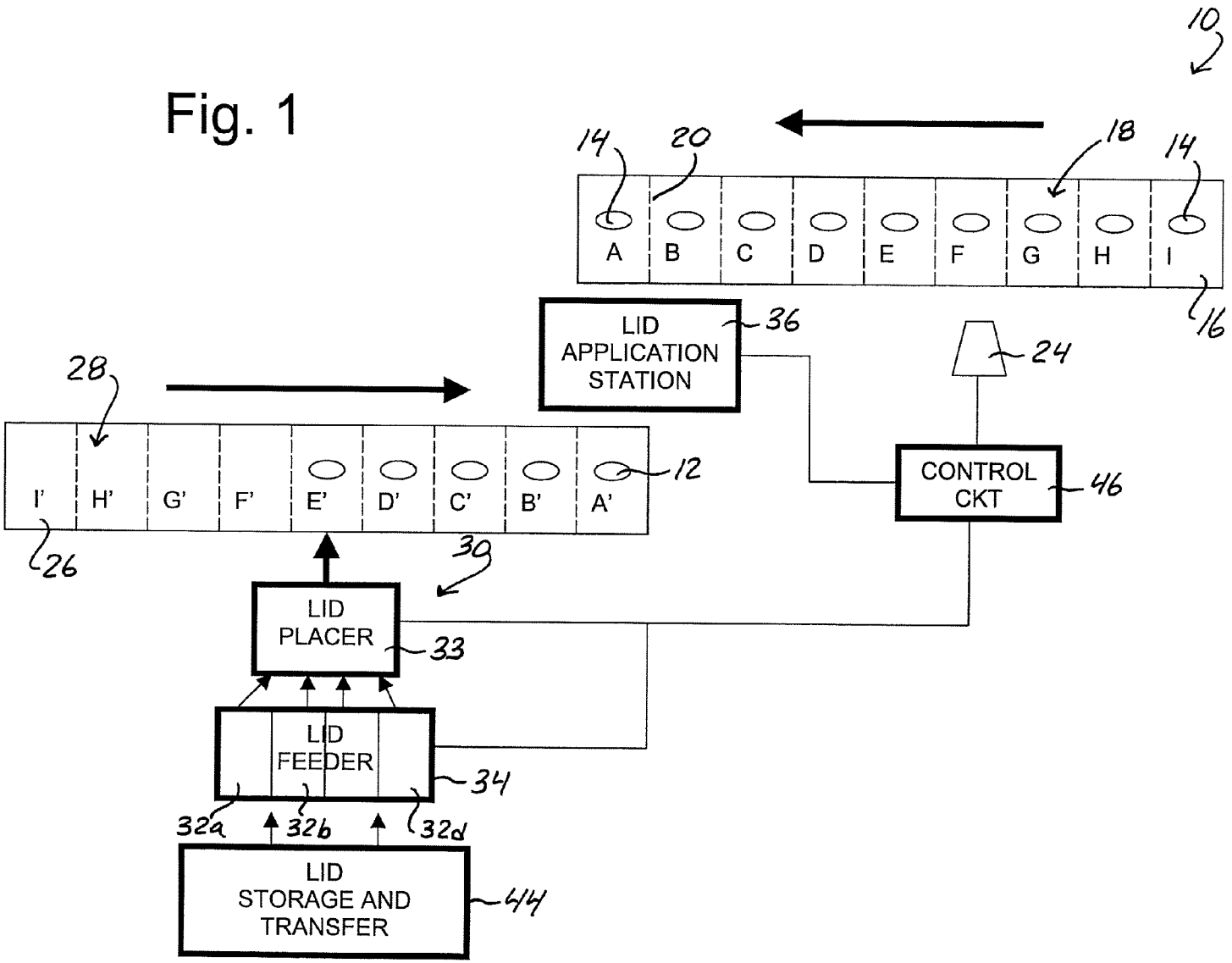
FIG. 1 is a schematic view of a processing line embodying the system and method of the present invention.

Repeat use of reference characters in the present specification and drawings is intended to represent the same or analogous features or elements of the present invention.

DETAILED DESCRIPTION

Reference will now be made in detail to one or more embodiments of the invention, examples of which are illustrated in the figures. It should be understood that each embodiment is provided by way of explanation of the invention, and not meant as a limitation of the invention. Features illustrated or described with respect to one embodiment may be used with another embodiment to yield still a further embodiment.

FIG. 1 represents an exemplary system and associated method for matching lids to cartons in accordance with aspects of the invention. The system 10 includes a carton feed conveyor 16 upon which individual cartons 14 are placed. The carton conveyor 16 is divided into a plurality of individual flight positions 18, with one carton 14 placed at each flight position 18. The different flight positions are labeled A through I in FIG. 1. The flight positions may be defined by a flight bar 20 or other guide structure configured with the conveyor 16 or movable therewith. The flight bar structure 20 may also serve the function of helping to align the individual cartons in a desired position or orientation at the individual flight positions 18. It should be appreciated that it is not necessary for each flight bar structure 20 to contain a carton, for example when carton flow is temporarily stopped or slowed compared to the lid application section processing speed.

Figure 4:
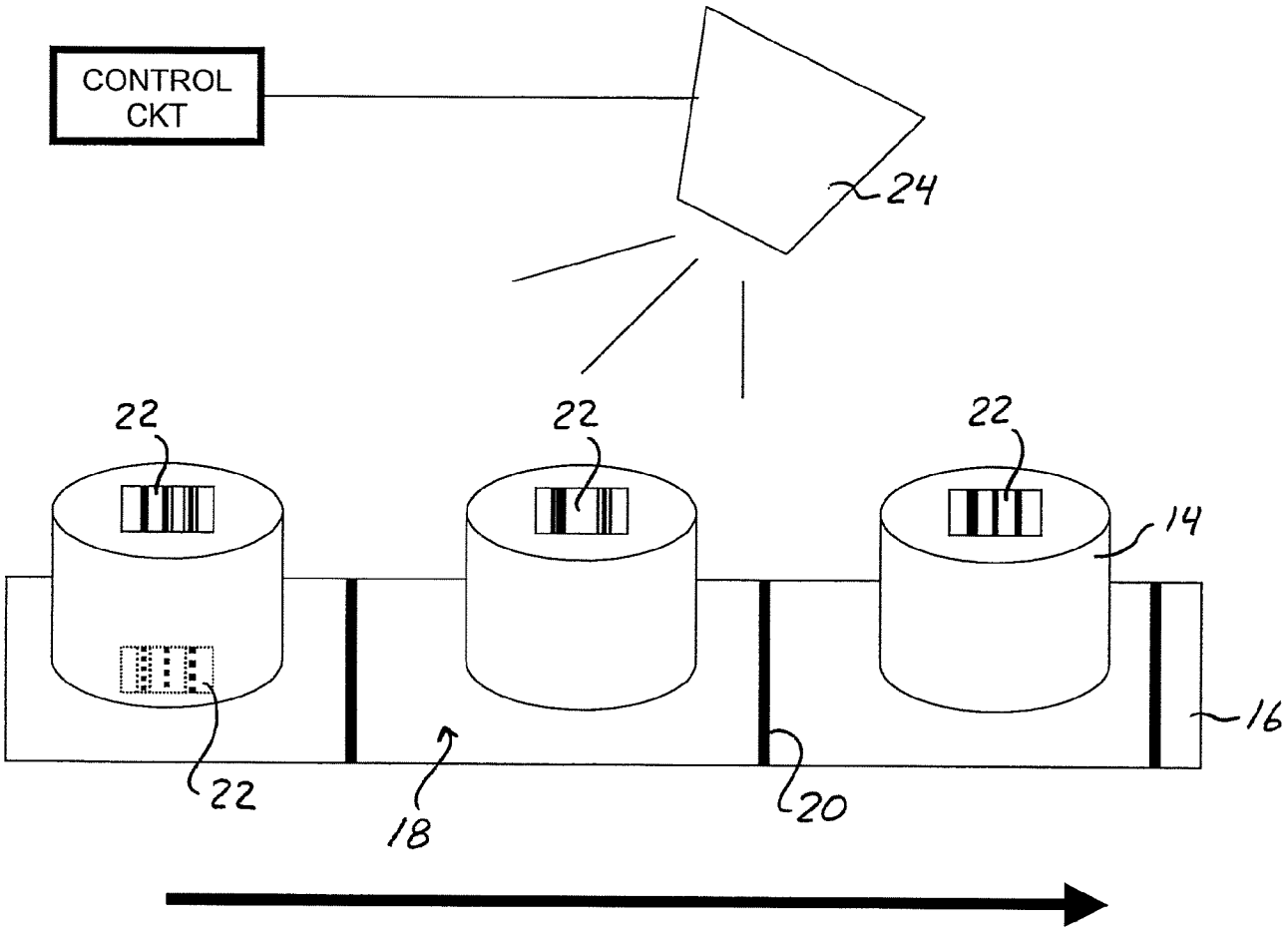
FIG. 4 is a partial perspective view particularly illustrating the process of reading individual marks on the carton bodies, the respective marks designating a particular type of lid to be applied to the body.

Referring to FIG. 4, each of the cartons 14 includes a mark 22 applied to a surface thereof. This mark 22 may be any indicia, pattern, color, or other readable medium applied to any desired surface of the carton. The mark 22 may be, for example, a part of a graphics pattern, or a color of a part of the carton, or a typical bar code or similar identification symbol that is applied to any desired surface on the carton 14. In general, the mark 22 may be considered as any feature that can be scanned or read and used as an indicator of a particular type of lid to be applied to the carton. The mark 22 may be applied to an inside surface of the carton 14, or any other surface that is not outwardly visible upon final assembly of the carton into a dispenser. The marks 22 indicate a particular type of lid that should be assembled with the respective carton 14. This "type" of lid may refer to the color of the lid, graphics on the lid, shape of the lid, or any other distinguishing feature that differentiates one lid from another. The marks 22 convey different information for the different types of carton bodies. For example, referring to FIG. 4, three cartons 14 are illustrated on the carton feed conveyor 16. These three cartons 14 may each have a different graphics design printed or otherwise applied to the carton sidewall. It is the intent that a unique lid be associated with each of the different types of cartons 14. Accordingly, each of the marks 22 is different for each of the cartons 14.

Referring to FIGS. 1 and 4, a reader 24 is operatively disposed relative to the carton feed conveyor 16 to read the individual marks 22 as the cartons 14 are conveyed past the reader 24. This reader 24 may be any suitable optical scanner or reader, such as a conventional bar code reader. The reader 24 is in communication with control circuitry 46, which is in further communication with the remaining components of the system 10, as explained in greater detail below.

Figure 2:
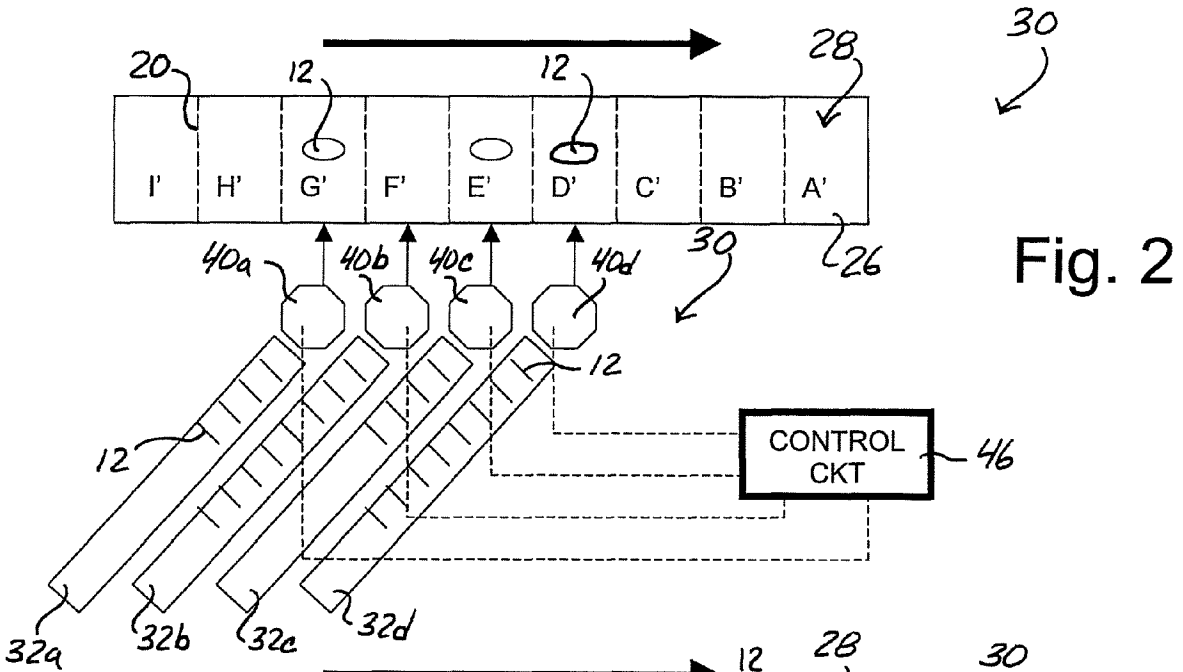
FIG. 2 is a schematic view of a particular embodiment of a lid placer station for use in the system and method of FIG. 1.
Figure 3:
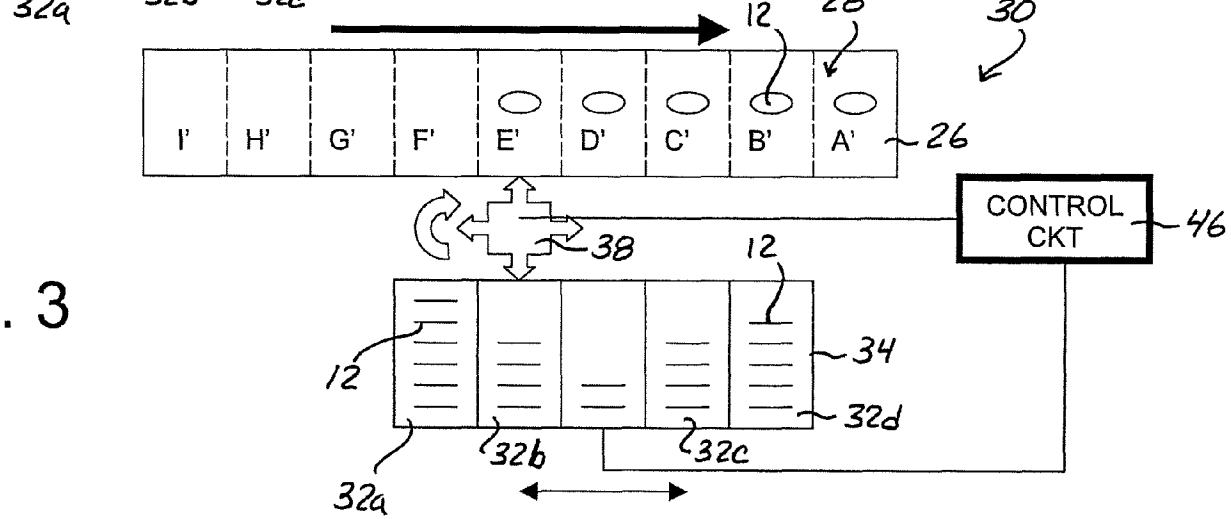
FIG. 3 is a schematic view of an alternative embodiment of a lid placer that may be used in the embodiment of FIG. 1.

Referring to FIGS. 1 through 3, the system 10 also includes a lid feed conveyor 26 having a plurality of flight positions 28 defined therealong. These flight positions 28 may be defined by flight bars 20, or the like, as discussed above. It should also be appreciated that the flight positions 28 on the lid feed conveyor 26, as well as the flight positions 18 on the carton feed conveyor 16, need not be defined by physical structure, but may simply be recognized by the control system 46 as spaced apart locations on the respective conveyors. The flight positions 28 in the embodiments of FIGS. 2 and 3, are labeled A' through I' and are associated with a respective flight position A through I on the carton feed conveyor 16. For example, the flight position 18 labeled A on the carton feed conveyor 16 is associated with the flight position 28 labeled A' on the lid feed conveyor 26. Likewise, flight position labeled B on the carton feed conveyor 16 is associated with the flight position 28 labeled B' on the lid feed conveyor 26. The respective flight positions are "associated" or "assigned" to each other in that a lid placed on a flight position 28 on the lid feed conveyor 26 is eventually applied to the carton 14 placed on the associated flight position 18 on the carton feed conveyor 16. Thus, the lid 12 placed on the flight position A' will be applied to the carton 14 placed on the flight position A of the carton feed conveyor 16.

A lid placer station 30 is supplied with the different types of lids necessary for application to the different types of cartons 14. For example, in the illustrated embodiment, four different types (e.g., different colors) of lids may be needed for four different types of carton bodies 14. These lids are carried by separate lid magazines 32*a*-32*d*. These individual lid magazines may be part of a larger lid feeder 34, or may be stand alone magazines, for example as illustrated in FIG. 2. The lid placer station 30 is operably configured alongside the lid feed conveyor 26 and serves to select and place the correct lids 14 from the respective magazines 32*a*-32*d* onto the associated flight positions 28 of the lid feed conveyor 26. In this regard, the lid placer station 30 is in communication with the reader 24 through the control circuitry 46.

Referring to FIG. 1, a lid application station 36 is disposed downstream of the lid feed conveyor 26 and the carton feed conveyor 16 and includes automated machinery for assembling the respective lids 12 to the cartons 14. In this regard, it should be understood that the speed and paths of the lid feed conveyor 26 and carton feed conveyor 16 are coordinated such that the respective assigned flight positions 18, 28, arrive at the lid application station 36 at about the same time. Automated machinery for assembling the lids 12 with the cartons 14 is well known and commercially available, and a detailed description thereof is not necessary for purposes of the present disclosure.

It should be appreciated that the control circuitry 46 represented schematically in the figures may be any combination of software and hardware components that serves to coordinate and interface the related functions of the components, and also preferably provides an operator interface and a control station. It is well within the level of those skilled in the art to design any suitable control system or circuit for this purpose.

FIG. 2 illustrates an embodiment of the lid placer station 30 wherein the lid placer includes a plurality of individual lid placer machines 40*a*, 40*b*, 40*c*, and 40*d*. Each of these machines 40*a*-40*d* serves to handle a single individual type of lid 12 from a respective magazine 32*a*-32*d*. For example, the machine 40*a* may place red lids carried in magazine 32*a*. Likewise, machine 40*b* may place blue lids from magazine 32*b*. Each of the individual machines 40*a*-40*d* are in communication with the control circuitry 46 so that the proper lid is applied to the correct flight position 28. For example, a lid 12 is illustrated placed at the flight position G'. This lid 12 may be a red lid placed by machine 40*a* and will be applied to a corresponding carton 14 on flight position G of the carton feed conveyor 16 having a mark 22 calling for a red lid. The flight position F' did not require a lid from machine 40*a* or 40*b*, but may be supplied with a lid from machine 40*c* or 40*d*.

The machines 40*a*-40*d* in the embodiment of FIG. 2 may be commercially available rotary placers, such as the Series 30 rotary placer from Thiele Technologies of Minneapolis, Minn., USA. These rotary placers may utilize single or multiple magazines and include a rotating head with vacuum nozzles for receiving an item from the magazine and positioning the item to a release position over the conveyor. The control circuitry 46 controls the vacuum nozzles depending on whether a lid is to be held or placed onto the flight position passing by the respective machine. Vacuum is automatically turned on or off to the respective nozzles to either place a lid or skip a lid placement at the respective flight positions.

In the embodiment of FIG. 2, it should be appreciated that each different type of lid 12 has a unique placement position relative to the lid feed conveyor 26. In other words, the lids in magazine 32*a* are always placed at a first relative position with respect to the conveyor 26. The type of lids in magazine 32*b* are always placed at a different position relative to the conveyor 26 that is downstream from the position of machine 40*a*, and so forth.

FIG. 3 illustrates an alternate embodiment wherein the lid placer is represented by a rotary turret placer 38. This turret placer 38 is at a single stationary position relative to the conveyor 26, and receives the different lids 12 from the respective magazines 32*a*-32*d* by way of a lid feeder 34 that reciprocates back and forth alongside of the conveyor 26. The turret-style placers are well known and commercially available. These devices typically include a rotating turret with numerous placement heads, each equipped with one or more vacuum nozzles. The nozzles allow each of the heads to pick up a component (lid) from one of the magazines, and to release the component onto the conveyor at the opposite side of the turret. These turret-style machines are relatively simple in design and are inherently fast. With the turret-style placer 38, it should be appreciated that all of the different types of lids 12 are placed onto the lid feed conveyor 26 at a single location relative to the conveyor, which may be important for purposes of space efficiency.

Referring to FIG. 1, the magazines 32*a*-32D in the lid feeder 34 (or stand-alone magazines) may be supplied from auxiliary lid storage devices 44, particularly for high processing speeds wherein manual reloading of the magazines is prohibitive. For example, the auxiliary equipment 44 might include lid feed hoppers and rotary bowls. For slightly slower speed applications, one or more carousel-type lid dispensers could contain multiple lid stacks, with each stack having a different lid color. The carousel could rotate to dispense the appropriate stacks via a chute or other guide configured between the carousel and the lid feeder magazines. It should be readily appreciated that any type of storage and transfer system may be utilized to supply the lid placer with additional lids upon depletion of the initial magazine of lids.

Figure 5:
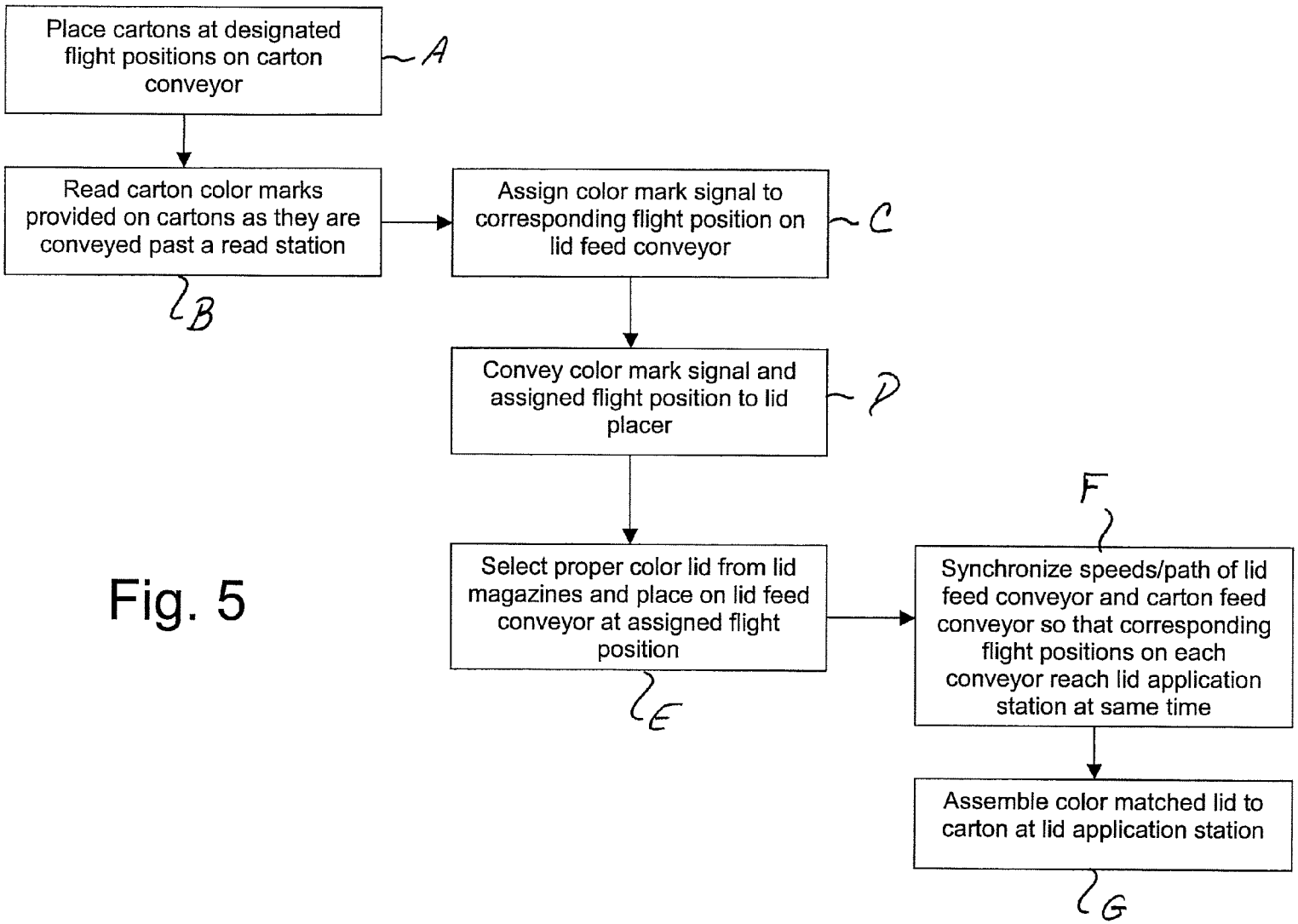
FIG. 5 is a block step diagram depicting methodology steps of the invention.

FIG. 5 is a block diagram flow chart representing certain basic methodology aspects of the invention relative to selection and placement of different colored lids onto respective cartons. It should be appreciated that the methodology is also applicable to lids having distinguishing features other than color, for example a graphics design, and the like. In step A, cartons are placed at designated flight positions on the carton conveyor. In step B, the color marks on the cartons are read as they are conveyed past a read station. In step C, the color mark signal of the respective cartons is assigned to a corresponding flight position on the lid feed conveyor. In step D, the color mark signal and assigned flight position on the lid feed conveyor are conveyed as control parameters to a lid placer station wherein, at step E, a proper colored lid is selected from one of a number of different lid magazines and placed on the lid feed conveyor at the assigned flight position. In step F, the speeds and traveling path of the lid feed conveyor and the carton feed conveyor are synchronized so that the corresponding flight positions on each of the conveyors reaches a lid application station at essentially the same time. In step G, the colored lid assigned to the respective cartons are assembled to the cartons at a lid application station.

It should be appreciated that the steps outlined in FIG. 5 may be carried out in any order, and that certain of the steps may be performed simultaneously.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A system for matching lids to cartons, comprising:

a carton feed conveyor having a plurality of cartons carried at individual flight positions defined along said carton feed conveyor, each of said cartons having a mark applied thereto indicating a type of lid to be applied to said respective carton;

a reader operatively disposed relative to said carton feed conveyor to read said marks;

a lid feed conveyor having a plurality of individual flight positions defined therealong, each said flight position on said carton feed conveyor having an assigned flight position on said lid feed conveyor;

a lid placer station supplied with different types of lids from respective separate lid magazines, said lid placer station disposed along said lid feed conveyor;

said lid placer station in communication with said reader and configured to select and place lids dictated by said marks from said magazines onto said flight positions on said lid feed conveyor that are assigned to said flight positions on said carton feed conveyor containing said carton and associated said mark read by said reader; and a lid application station downstream of said lid placer station, the movement and traveling path of said lid feed conveyor and said carton feed conveyor coordinated so that said respective assigned flight positions arrive at said lid application station at generally the same time.

2. The system as in claim 1, wherein said marks indicate a color of lid to be applied to said cartons, and said magazines contain different colored lids.

3. The system as in claim 1, wherein said marks comprise printed matter applied to said cartons.

4. The system as in claim 3, wherein said printed matter is applied to an outwardly non-visible surface of said carton.

5. The system as in claim 1, wherein said lid placer station comprises a single lid placer, said magazines carried by a lid feeder that reciprocates relative to said lid placer.

6. The system as in claim 5, wherein said lid placer comprises a turret placer, with all of said different lids being placed by said turret placer at the same relative position with respect to said lid feed conveyor.

7. The system as in claim 1, wherein said lid placer station comprises a plurality of lid placers, with each lid placer assigned a respective said magazine, said lid placers spaced apart along said lid feed conveyor at said lid placer station.

8. The system as in claim 7, wherein said lid placers comprise individual rotary placers, with each different type of lid being placed at a unique relative position with respect to said lid feed conveyor.

9. The system as in claim 1, wherein said cartons comprise facial tissue dispensing cartons having different graphics designs applied thereto, and said magazines contain a different colored lid for each of said graphics designs.

10. The system as in claim 1, further comprising a lid storage device operatively configured with said magazines.

11. A method for matching lids to cartons in a production line, said method comprising:

placing cartons at designated flight positions along a carton conveyor, the cartons having different appearances and a mark applied thereto indicating a type of lid to be applied to the respective carton;

reading the mark provided on the cartons as they are conveyed on the carton conveyor;

assigning the lid requirement of the read mark to an associated flight position of a separate lid conveyor;

based on the read mark, selecting the proper type of lid from a supply of different types of lids and placing the selected lid on the associated flight position on the lid conveyor;

synchronizing the carton and lid conveyor so that the associated flight positions arrive at a lid application station at generally the same time; and applying the lids to the cartons at the lid application station.

12. The method as in claim 11, wherein the marks are placed on surfaces of the cartons that are not outwardly visible.

13. The method as in claim 11, wherein the marks dictate the color of a lid to be applied to the respective carton, the supply including lids of different required colors.

14. The method as in claim 11, wherein all of the different types of lids are placed onto the lid conveyor from the same relative position with respect to the lid conveyor.

15. The method as in claim 14, wherein all of the different types of lids are supplied to the relative position from a reciprocating lid feeder.

16. The method as in claim 11, wherein each of the different types of lids are placed onto the lid conveyor from a unique relative position with respect to the lid conveyor,

17. The method as in claim 16, wherein a separate lid magazine and lid placer is provided at each unique position.

* * * * *